US010255892B1

(12) United States Patent
Gutsman

(10) Patent No.: US 10,255,892 B1
(45) Date of Patent: Apr. 9, 2019

(54) GUITAR HAVING A RESONATOR ACCESSORY

(75) Inventor: Vladimir P. Gutsman, Sedalia, MO (US)

(73) Assignee: Vladimir P Gutsman

( * ) Notice: Subject to any disclaimer, the term of this patent is extended or adjusted under 35 U.S.C. 154(b) by 81 days.

(21) Appl. No.: 12/417,145

(22) Filed: Apr. 2, 2009

(51) Int. Cl.
*G10D 1/08* (2006.01)
*G10D 3/04* (2006.01)

(52) U.S. Cl.
CPC ..... *G10D 3/04* (2013.01)

(58) Field of Classification Search
USPC ..... 84/267, 293, 307, 311, 290
See application file for complete search history.

(56) References Cited

U.S. PATENT DOCUMENTS 4,840,102 A * 6/1989 Pittman ..... 84/293
5,503,054 A * 4/1996 Ellsworth et al. ..... 84/307

FOREIGN PATENT DOCUMENTS

JP 56108642 A * 8/1981

* cited by examiner

*Primary Examiner* — Kimberly R Lockett

(57) ABSTRACT

Disclosed is a set of guitar accessories comprising a headstock plate adapted to be attached to a backside of the headstock of a guitar, and a bridge plate adapted to be placed inside a body of the guitar under the bridge, the headstock plate and the bridge plate being made of brass. Also disclosed are a version of the bridge plate located outside the guitar and a guitar comprising the headstock plate and bridge plate.

8 Claims, 6 Drawing Sheets

GUITAR HAVING A RESONATOR ACCESSORY

FIELD OF THE INVENTION

The present disclosure relates to string instruments, more particularly to guitars, for example electric guitars, and even more particularly, pertains to an accessory for guitars aimed at improving guitar's sounding.

BACKGROUND OF THE INVENTION

Known from U.S. Pat. No. 7,259,308 issued on Aug. 21, 2007, to John F. Geiger is a resonator assembly that includes a resonator, a collector-amplifier, as well as a timbre tray, one or more timbre pieces, and a detector holder. The resonator assembly, designed to be attachable to a conventional acoustic guitar, improves the quality and volume of the conventional guitar. A wood or metal timbre piece or a varying combination thereof may be used according the user's sound preference. The resonator, the collector-amplifier, the timbre holder tray and the detector holder are preferably made from thin brass.

Also known in the art is a bridge pin for stringed instruments that is formed of a high density metal, such as brass or the like (see U.S. Pat. No. 4,197,779 of Apr. 15, 1980, issued to Mitchell R. Holman). While it has generally been thought that a heavy bridge pin would damp the string vibration, the patent appears to show that quite the contrary is true. The disclosed bridge pin materially improves the presence, i.e. the volume of frequencies between 2,000 and 10,000 cycles/second. Additionally, and also unexpectedly, the improved bridge pin of that invention is said to materially improve the sustain, i.e. the time duration of string resonance. The bridge pin of the invention is formed of brass or other material having a substantial density as of the order of brass.

A need still exists for means that would enhance tonal quality of string instruments such as guitars.

SUMMARY OF THE INVENTION

The goal is proposed to attain by providing a set of guitar accessories that comprises a headstock plate to be attached to a backside of the headstock of a guitar, and a bridge plate to be placed inside a body of the guitar under the bridge.

The headstock plate and the bridge plate would be made of brass, preferably naval brass.

The bridge plate can be made J-shaped, with an elongated portion and a bent portion. The elongated portion of the J can be longitudinally cambered toward the bent portion, whereas the bent portion of the J can be shaped transversely widening and made with two prongs, the distance between the prongs corresponding to the width of the bridge of the guitar. The curvature of the camber of the elongated portion is about 3-3.5 degrees. The prongs can be provided with mounting holes for attaching the bridge plate to the body of the guitar.

In another embodiment, a set of guitar accessories comprises a headstock plate that can be attached to a backside of the headstock of a guitar, and a bridge plate that can be placed on a body of the guitar in the area of the bridge. Both the headstock plate and the bridge plate are made of brass, preferably naval brass.

In the second embodiment, the bridge plate can be made L-shaped comprising an elongated portion and a base portion. The elongated portion can be of the profile transversely widening toward the bridge and can be made with two prongs, the distance between the prongs corresponding to the width of the bridge of the guitar. The prongs can be provided with mounting holes for attaching the bridge plate to the body of the guitar. The base portion of the bridge plate can fit to a bottom side of the body of the guitar and be attached to the side. Holes can be made in the headstock plate aligning with tuning pegs of the guitar.

The above-identified features of the guitar accessories are believed to enhance the resonant qualities and sustain of the instrument, which would create a fuller, richer sound and enhance the instrument's tone.

BRIEF DESCRIPTION OF THE DRAWINGS

Other objects, features and advantages of the disclosure will become apparent to one skilled in the art by reading the following specification and subjoined claims and by referencing the following drawings, in which:

DETAILED DESCRIPTION OF THE PREFERRED EMBODIMENT

Figure 1:
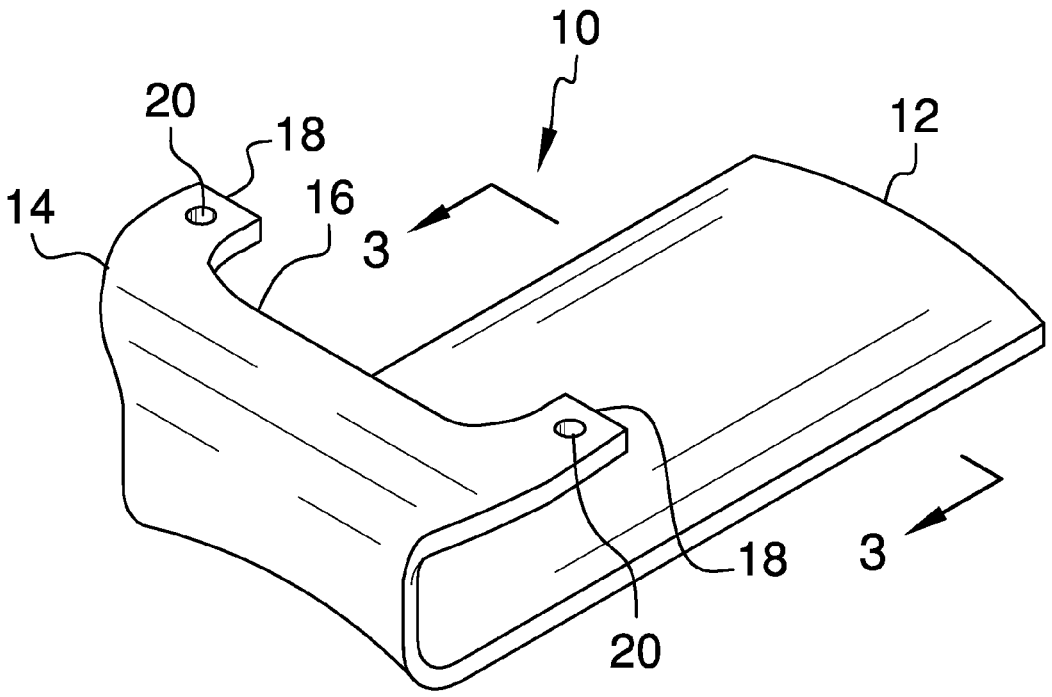
FIG. 1 is a perspective view of a bridge plate according to the present invention.

Before starting a detailed description of the disclosure, mention of the following is in order. When appropriate, like reference numerals and characters may be used to designate identical, corresponding, or similar components in different figure drawings.

Figure 3:
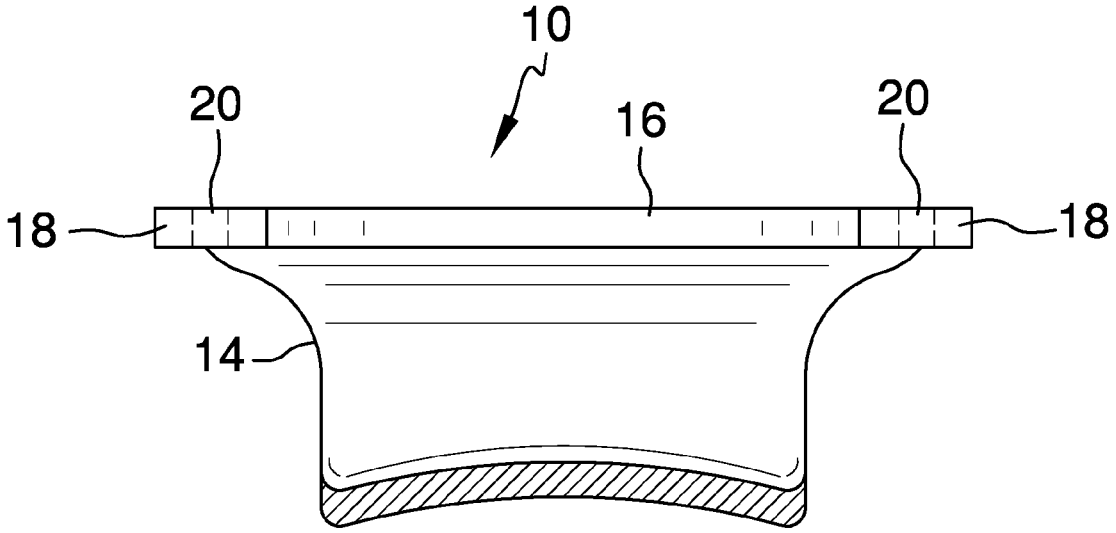
FIG. 3 illustrates a cross-section of the bridge plate made along lines 3-3 of FIG. 1.

Referring now to the drawings of FIGS. 1 and 3, a bridge plate 10 made of brass, preferably naval brass, is shaped into a J-like profile and comprises an elongated portion 12 and a bent portion 14. As it is clearly shown in FIG. 3, the elongated portion 12 is cambered toward the bent portion 14, the camber being selected of about 3-3.5 degrees. The bent portion 14 widens toward its edge 16 and is provided with two prongs 18. Each of the prongs 18 is provided with a mounting hole 20.

Figure 2:
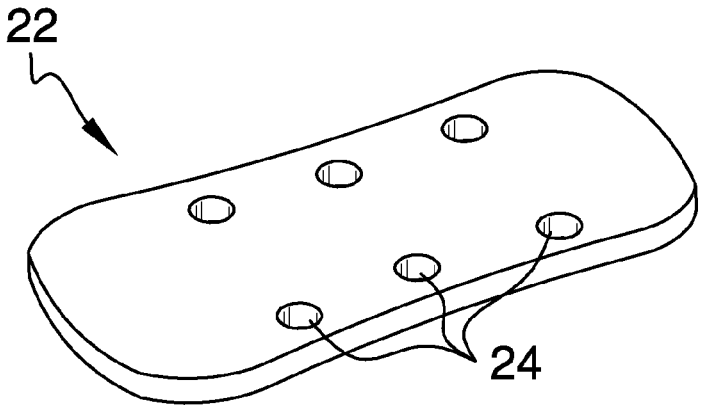
FIG. 2 shows a perspective view of a headstock plate according to the present invention.

Shown in FIG. 2 a headstock plate 22 is of a rectangular form, preferably with rounded corners. It is made with a plurality (shown six) of mounting holes 24. The arrangement and specific number of the holes, as well as the specific shape of the headstock itself depend on the type and size of the instrument the plate is supposed to be attached to.

Figure 4:
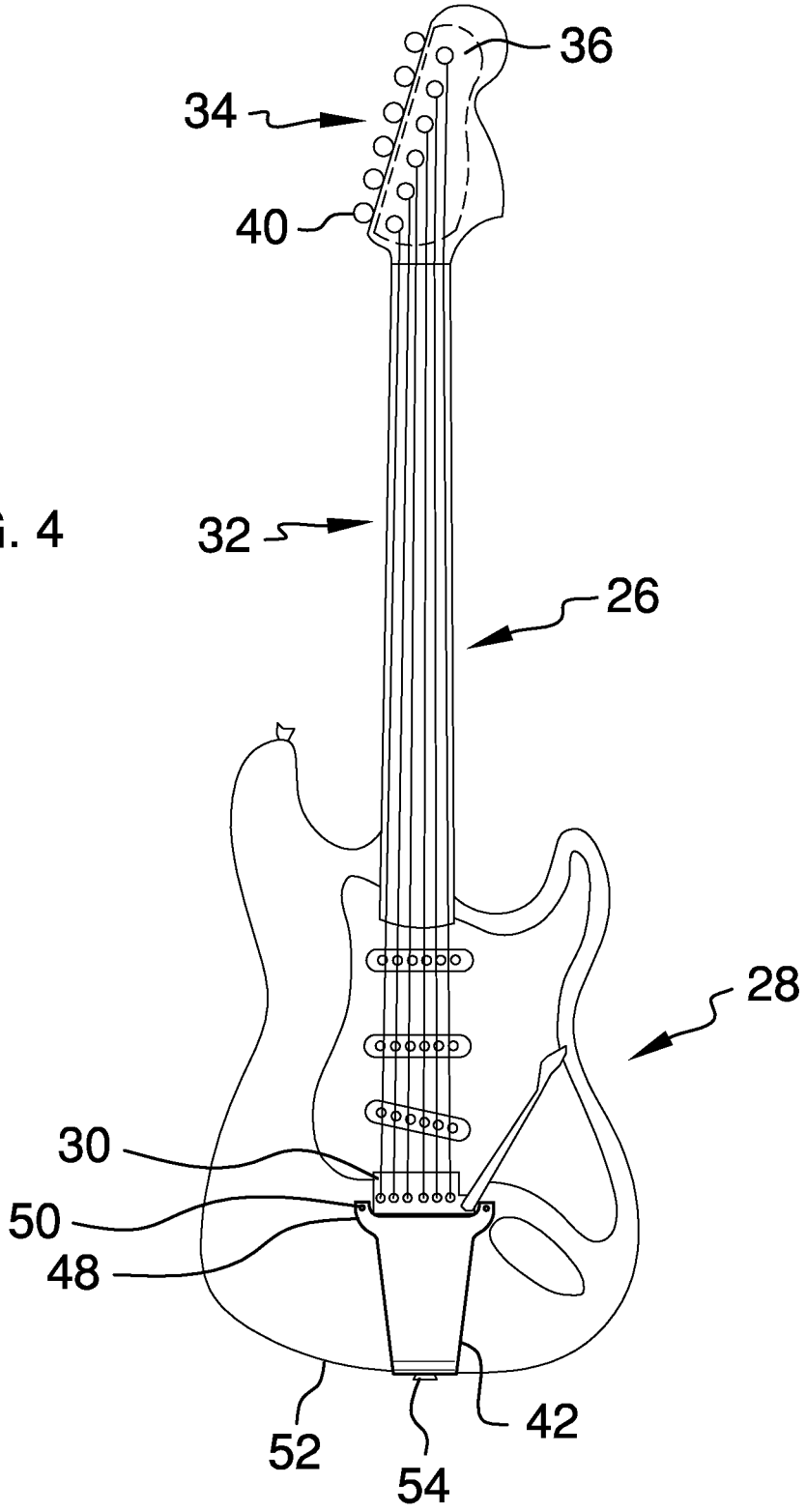
FIG. 4 is a front view of a guitar provided with the headstock plate and an external version of the bridge plate according to the present invention.
Figure 5:
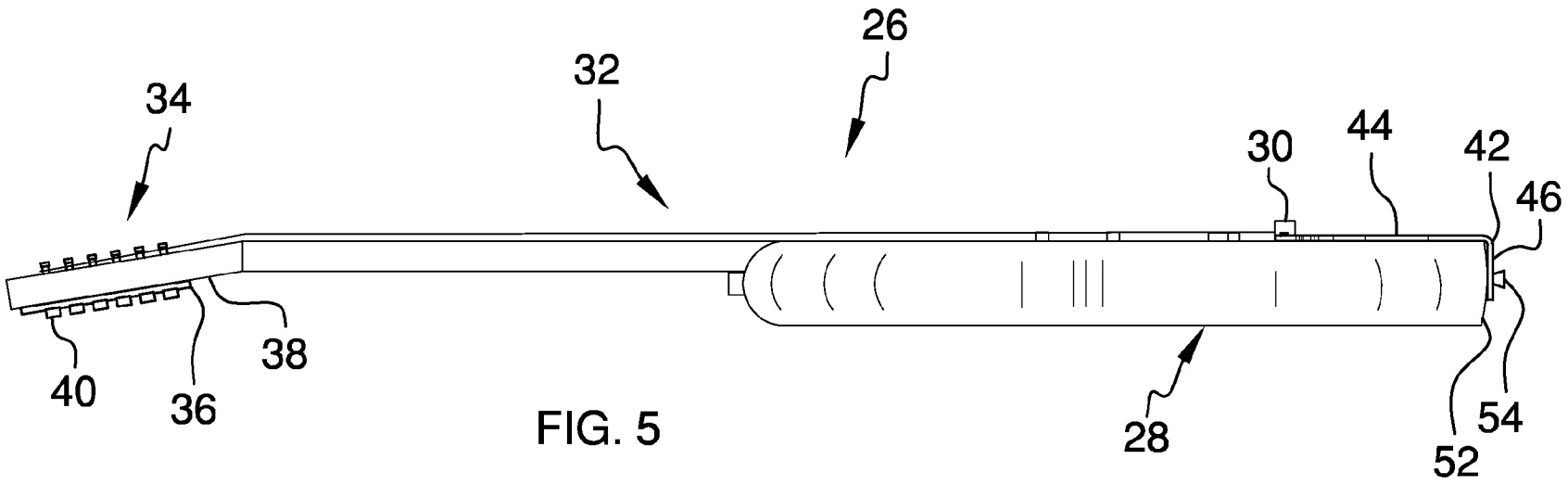
FIG. 5 depicts a side view of a guitar provided with the headstock plate and an external version of the bridge plate according to the present invention.

A guitar 26 depicted in FIGS. 4 and 5 comprises a body 28 with a bridge 30, a finger board 32 and a headstock 34. A headstock brass plate 36 somewhat repeating the silhouette of the headstock is attached to the backside 38 of the headstock with the holes (not shown) in the plate aligning with tuning keys 40 of the headstock.

An L-shaped brass bridge plate 42 has an elongated portion 44 and a base portion 46. The elongated portion 44 is made widening toward the bridge 30 and having two prongs 48 with mounting holes 50. The distance between the prongs 48 is selected corresponding to the width of the bridge. The size of the plate 42 is selected in such a way that the base portion 46 fit to the bottom 52 of the body of the guitar. A mounting means 54 attaches the base portion to the guitar body.

Figure 6:
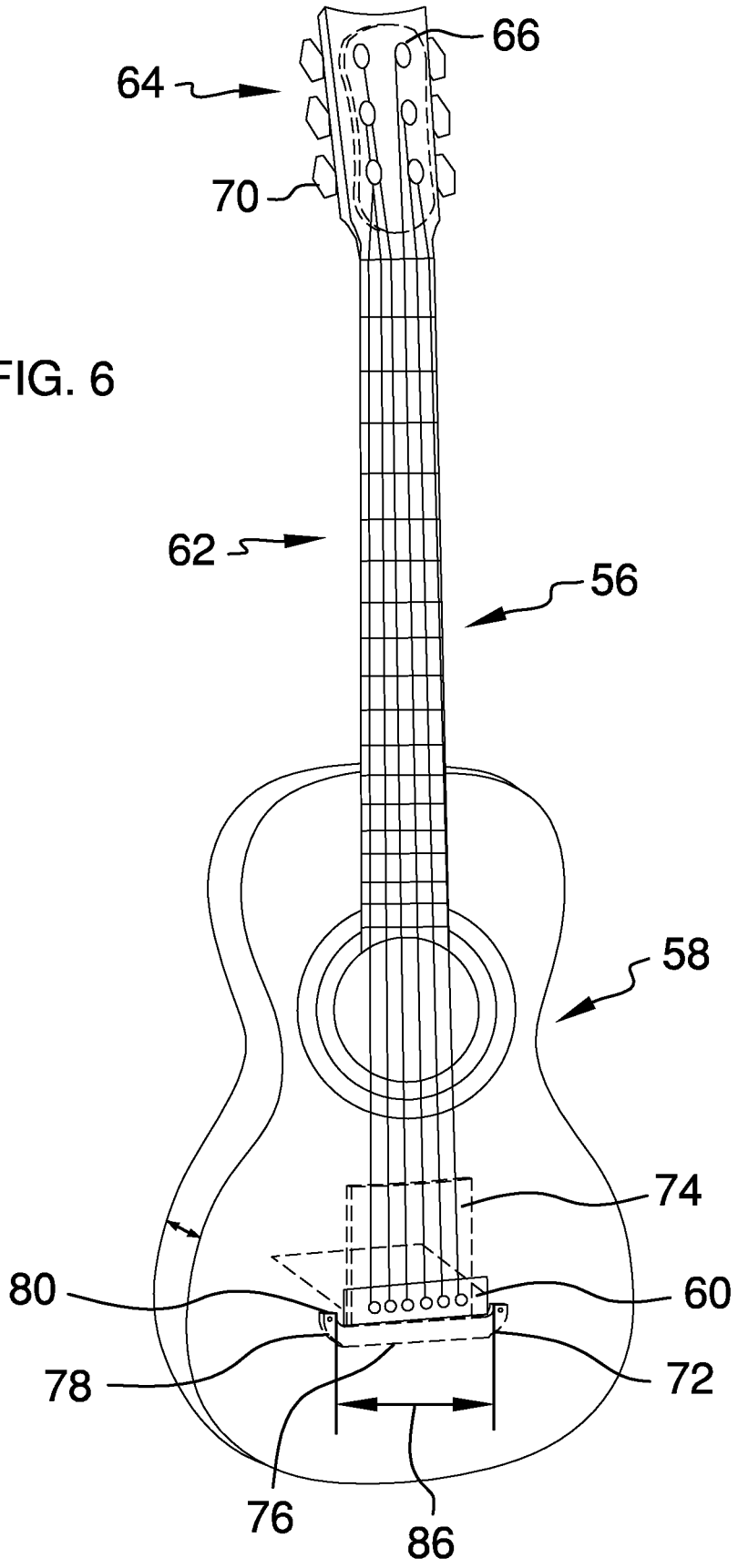
FIG. 6 is a perspective view of a guitar provided with a headstock plate and an internal version of the bridge plate according to the present invention.
Figure 7:
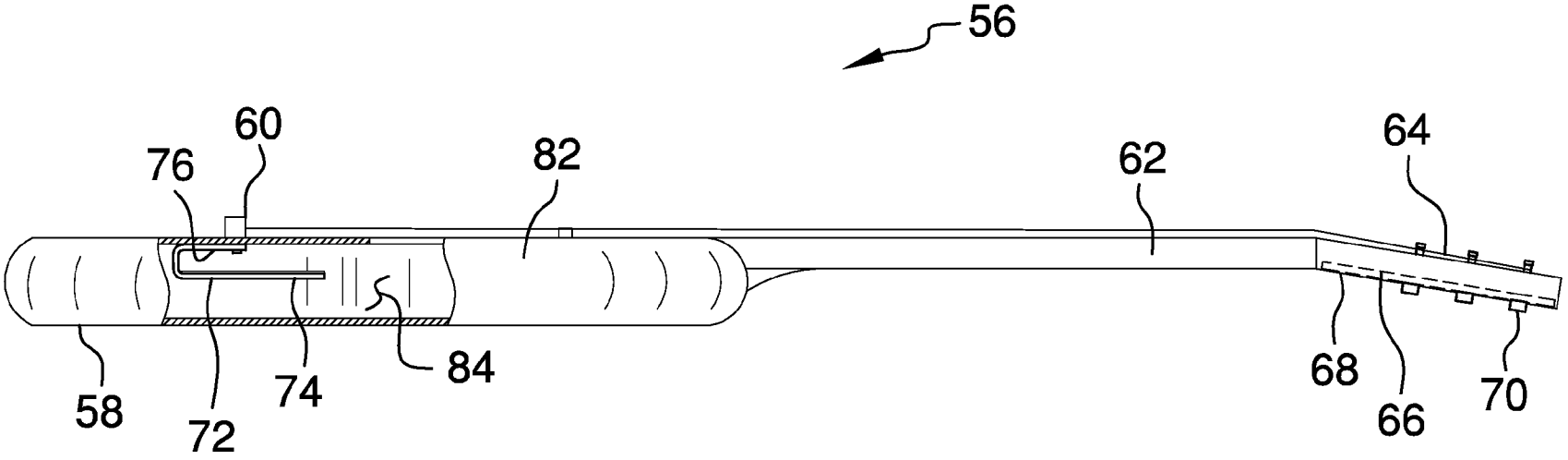
FIG. 7 illustrates a side view of a guitar provided with the headstock plate and the internal version of the bridge plate according to the present invention.

A guitar 56 depicted in FIGS. 6 and 7 comprises a body 58 with a bridge 60, a finger board 62 and a headstock 64. A headstock brass plate 66 is attached to the backside 68 of the headstock with the holes (not shown) in the plate aligning with tuning keys 70 of the headstock. As shown in FIG. 7, the headstock plate 66 can be partially recessed into the headstock 64.

A J-shaped brass bridge plate 72 has an elongated portion 74 and a bent portion 76. The elongated portion is longitudinally cambered toward the bent portion, the camber being selected to be of about 3-3.5 degrees. The bent portion 76 is made widening toward the bridge 60 and has two prongs 78 with mounting holes 80 therein. There is a cut-away made in a side 82 of the body 58 for illustrative purposes to show a cavity 84 inside the body 58. The bridge plate 72 is located in the cavity 84 and is attached to the body from inside. Since the distance 86 between the prongs is selected corresponding to the width of the bridge 60, the bridge plate 72 when attached to the body 58 looks as if it embraces the bridge 60 with the prongs 78. The elongated portion 74 is left suspended in the cavity 84.

It is believed that when incorporated into the design of a guitar (electric guitar, for example), the set of accessories disclosed in the above would enhance the resonant qualities and sustain of the instrument, which would create a fuller, richer sound and enhance the instrument's tone.

The set of the accessories can be offered as an OEM feature on newly manufactured electric guitars. They could be offered in stock configurations, or consumers could potentially choose the size and shape of the plates they wanted incorporated into their instruments. The plates could also be incorporated into the designs of acoustic guitars, as well as into the designs of other string instruments such as bass guitars, banjos, mandolins, cellos, violas, violins, etc.

The plates could be offered as aftermarket accessories that could be installed on the exterior of a guitar either by the owner of the instrument or by a qualified guitar technician. For instance, the plate for a guitar's headstock would be cut and shaped to fit over the headstock's top surface and drilled with a series of holes to accommodate the instrument's tuning pegs.

Once the set was incorporated into, or installed on, a guitar, an individual would simply play the guitar in the conventional manner. The addition of the brass plates on the instrument's headstock and body would enhance the resonant qualities of the guitar, which would allow for a fuller, richer, and a more balance tones, as well as increased sustain from the instrument's strings. In turn, this would improve the overall sound of the instrument, which would make it more enjoyable to play.

It is believed that the set of accessories for a guitar described in the above would fulfill the need for means that would enhance the resonant qualities of a guitar. The appealing features of the set would be its simple and effective design and ability to enhance a guitar's tonal qualities. The brass plates of the present invention would be incorporated into the headstock and body of a newly manufactured electric guitar. Since brass is a material known for its resonant qualities, the plates would resonate when the guitar's strings were picked or strummed. This would enhance the resonant qualities of the guitar's body and thus provide a richer, more balanced tone, as well as increased sustain. In turn, this would give the instrument a fuller overall sound, which would not only enhance playability but could allow the musician to be more creative when playing when attempting to get different types of tones from the instrument or when creating different "patches" using various types of signal processing gear.

In addition, the set would provide the guitar makers with a new feature that would enhance the tonal qualities of their guitars. Guitar makers could offer the plates in stock designs or could create specially designed plates for guitarists who wished to customize their instruments according to taste. This would enhance the marketability of a manufacturer's instruments, which could increase sales and revenue. Furthermore, the plates of the set could also be offered as aftermarket accessories that could be installed on existing guitars. This would allow guitarists to improve the sounds of their existing instruments and would eliminate the need to purchase an entirely new guitar in order to enjoy the benefits of the product.

Naturally, the set could be incorporated into both acoustic and electric guitars. The plates could also be incorporated into the designs of other string instruments including bass guitars, banjos, mandolins, violins, violas, cellos, etc. This new product would be innovative in design, resonance enhancing, sonically pleasing, convenient, practical, and durable for years of effective use.

Those skilled in the art can now appreciate from the foregoing description that the broad teachings of the present disclosure can be implemented in a variety of forms. Therefore, while the guitar accessory set of the present disclosure has been described in connection with particular examples thereof, the true scope of the disclosure should not be so limited since other modifications will become apparent to the skilled practitioner upon a study of the drawings, specification and claims that follow.

What is claimed is:

1. A set of guitar accessories comprising a headstock plate adapted to be attached to a backside of the headstock of a guitar, and a bridge plate adapted to be placed inside a body of the guitar under the bridge, the headstock plate and the bridge plate being made of brass;

wherein the bridge plate is made J-shaped comprising an elongated portion and a bent portion, the elongated portion longitudinally cambered toward the bent portion, the bent portion being of transversely widening profile and being made with two prongs, a distance between the prongs corresponding to the width of the bridge of the guitar.

2. The set of guitar accessories as claimed in claim 1 wherein brass includes naval brass.

3. The set of guitar accessories as claimed in claim 1 wherein holes are made in the headstock plate aligning with tuning pegs.

4. The set of guitar accessories as claimed in claim 1 wherein curvature of the camber of the elongated portion is about 3-3.5 degrees.

5. The set of guitar accessories as claimed in claim 1 wherein the two prongs are provided with mounting holes for attaching the bridge plate to the body of the guitar.

6. A set of guitar accessories comprising a headstock plate adapted to be attached to a backside of the headstock of a guitar, and a bridge plate adapted to be placed on a body of the guitar in the area of the bridge, the headstock plate and the bridge plate being made of brass, the bridge plate being made L-shaped comprising an elongated portion and a base portion, the elongated portion being of transversely widening profile and being made with two prongs, a distance between the prongs corresponding to the width of the bridge of the guitar, the two prongs being provided with mounting holes for attaching the bridge plate to the body of the guitar, the base portion being adapted to fit to a bottom side of the body of the guitar and to be attached thereto, holes being made in the headstock plate aligning with tuning pegs of the guitar.

7. A guitar comprising a body with bridge, a fingerboard, and a headstock, wherein a headstock plate and a bridge plate are provided, the headstock plate being adapted to be attached to a backside of the headstock, and a bridge plate being adapted to be placed in the area of the bridge, the headstock plate and the bridge plate being made of brass;

wherein the bridge plate is made L-shaped comprising an elongated portion and a base portion, the elongated portion being of transversely widening profile and being made with two prongs, a distance between the prongs corresponding to the width of the bridge, the two prongs being provided with mounting holes for attaching the bridge plate to the body enveloping the bride the base portion being adapted to fit to a bottom side of the body and to be attached thereto.

8. The guitar as claimed in claim 7, wherein the backside of the headstock is made with a recess, and the headstock plate is placed into the recess.

* * * * *